US006628058B2

(12) United States Patent
Park

(10) Patent No.: US 6,628,058 B2
(45) Date of Patent: Sep. 30, 2003

(54) FLAT TENSION MASK TYPE CATHODE RAY TUBE

(75) Inventor: Ki Bum Park, Kyongsan (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/829,973

(22) Filed: Apr. 11, 2001

(65) Prior Publication Data

US 2001/0043037 A1 Nov. 22, 2001

(30) Foreign Application Priority Data

Apr. 12, 2000 (KR) ..... 2000-19320

(51) Int. Cl.[7] ..... H01J 29/80
(52) U.S. Cl. ..... 313/407; 313/402; 313/408
(58) Field of Search ..... 313/407, 402, 313/408, 7, 8

(56) References Cited

U.S. PATENT DOCUMENTS 4,565,946 A * 1/1986 Barrett et al. ..... 313/408
5,532,545 A * 7/1996 Okamoto et al. ..... 313/402
5,818,156 A * 10/1998 Misono ..... 313/412
6,107,729 A * 8/2000 Banno ..... 313/403
6,139,996 A * 10/2000 Choi et al. ..... 106/287.18
6,246,163 B1 * 6/2001 Matsudate et al. ..... 313/402
6,411,025 B1 * 6/2002 Bae ..... 313/403

* cited by examiner

*Primary Examiner*—Sandra O'Shea
*Assistant Examiner*—Sumati Krishnan
(74) *Attorney, Agent, or Firm*—Fleshner & Kim, LLP

(57) ABSTRACT

The present invention relates to a flat tension mask type CRT which improves structures of a shadow mask and a panel, herein the shadow mask has a thickness of 50 $\mu$m~80 $\mu$m, the panel has a transmittance of 47%~50%, the flat CRT has a luminance of not less than 31FL, and the panel has a thickness of 13 mm~14.5 mm, accordingly the present invention is capable of heightening productivity and durability, and at the same time improving overall luminance and color vividness by increasing the thickness of the shadow mask.

15 Claims, 5 Drawing Sheets

FLAT TENSION MASK TYPE CATHODE RAY TUBE

BACKGROUND OF THE INVENTION

1. Field of the Invention

The present invention is relates to a flat CRT (Cathode Ray Tube), in particular to a flat tension mask type CRT which improves structures of a shadow mask and a panel.

2. Description of the Prior Art

In general, a cathode ray tube is for reproducing a received electric signal into a video signal, it is used for a video displaying apparatus such as a television, a monitor etc., and it is divided into a curved surface type and a flat type.

Between the above-mentioned CRT, the flat CRT which is superior than the curved CRT in the image distortion and outer light reflexibility aspects will now be described.

As depicted in FIG. 1, a general flat CRT 1 comprises a panel 13, a funnel 14, and an electron gun 17.

The panel 13 comprises a fluorescent screen 11 constructed with red, green, blue stripes or dots shape fluorescent material, and a safety glass 12 adhered to the front surface by a resin as a hardening adhesion for preventing damage of the panel 13 due to durability lowering caused by the flat surface of the panel 13.

In addition, a shadow mask 18 is fixedly formed on a rail 15 adhered to the back of the fluorescent screen 11 of the panel 13 by welding.

And, the funnel 14 as a vacuum bulb is fixedly formed on the rear of the panel 13, the electron gun 17 for scanning an electron beam 16 is placed in a neck unit 14*a* of the funnel 14, and a deflection yoke 21 for deflecting the electron beam 16 is installed on the outer circumference of the neck unit 14*a*.

Particularly, as depicted in FIG. 2, the shadow mask 18 is fabricated as a very thin film having a thickness of about 25 $\mu$m in order to improve a transmittance of the electron beam 16, and a plurality of through holes 19 are formed with a certain interval.

The plurality of through holes 19 are formed by an etching process in fabrication of the shadow mask 18, as depicted in FIG. 3, an outlet size $L_0$ of the through hole 19 on the front surface is bigger than an inlet size $L_1$ of the through hole 19 on the inner surface.

Meanwhile, a vertical direction width between the through holes 19 on the shadow mask 18 is called as a bridge width W.

A video reproducing process of the above-described flat CRT will now be described.

As depicted in FIG. 1, the received electric signal is controlled, accelerated, collimated by a voltage applied to each electrode, and its orbit is adjusted to a horizontal direction or a vertical direction by a magnetic field of the deflection yoke 21.

After that, as depicted in FIG. 3, the deflected electron beam 16 radiates the fluorescent material of the fluorescent screen 11 coated on the back of the panel 13 by passing through the through hole 19 of the shadow mask 18, accordingly a picture is reproduced.

However, in the above-mentioned shadow mask 18 used for the conventional flat CRT, a rolling process is additionally required in order to fabricate the shadow mask 18 as a very thin film having a thickness of about 25 $\mu$m, deformation of the mask largely occurs in the etching process for forming the through hole 19, an error such as a fracture etc. occurs in fabrication process of the flat CRT (Cathode Ray Tube), accordingly fabrication of the shadow mask is not easy, error rate in fabrication is high, handling is difficult, and the price is high.

In addition, in the conventional flat CRT, when the shadow mask 19 is fixed to the rail 15, a rip etc. can occur due to a shear stress, because the heat quantity of the shadow mask 18 is small, a doming can occur due to collision of the electron beam and the electron beam can not land accurately on the fluorescent material, accordingly luminance and color vividness of the picture quality can lower.

Because of the above-mentioned problems, as depicted in FIG. 4, when the thickness t of the shadow mask 18 increases from (a) to (b), a size $L_1'$ of the through hole on the inner surface can be fabricated as same with the size $L_1$ which is the size when the shadow mask 18 has a thickness t of 25 $\mu$m in fabrication of a through hole 19' of a shadow mask 18' with the etching process.

However, in the shadow mask 18', because of a problem from the fabrication technology point of view, a size $L_0'$ of the through hole 19' on the front surface has to be a little smaller than the size $L_0$ when the shadow mask 18 has a thickness t of 25 $\mu$m.

Accordingly, in the shadow mask 18' having the increased thickness t', the inner surface 19*a*' from the inlet to the outlet of the through hole 19' is formed gently, and the bridge width W' between the through holes 19' increases.

In order to improve the durability of the shadow mask 18, when the thickness t increases, because the outlet size $L_0'$ of the through hole 19' decreases due to a difficult point of the fabrication process of the through hole 19', the transmittance of the electron beam decreases.

It can be described as below table 1.

TABLE 1

| Shadow Mask Thickness (t) | Bridge Width (W) | Luminance of CRT (FL) |
|---|---|---|
| 25 $\mu$m | 0.027 mm | About 31.5 FL |
| 50 $\mu$m | 0.035 mm | About 30.4 FL |
| 80 $\mu$m | 0.038~0.040 mm | About 29.9 FL |

As described in table 1, when the shadow mask 18' has a thickness of not less than 50 $\mu$m, because the outlet size $L_0'$ of the through hole 19' decreases, the bridge width W' increases. Herein, the electron beam transmittance of the shadow mask 18' decreases not less than 10%.

After all, when the thickness t increases in order to improve the durability of the shadow mask 18, the electron beam transmittance decreases, the ratio of the electron beam 16 for radiating the red, green, blue fluorescent material of the fluorescent screen 11 decreases, accordingly the luminance as the brightness of the CRT lowers.

SUMMARY OF THE INVENTION

In order to solve above-mentioned problems, the object of the present invention is to provide a flat CRT (Cathode Ray Tube) which is capable of making fabrication and handling of a shadow mask easier by designing a panel so as to get an appropriate luminance while increasing a thickness of the shadow mask, and improving a picture quality by heightening the final luminance of the CRT.

In order to achieve the object of the present invention, the flat tension mask type CRT in accordance with the present invention comprises a flat panel fixed to the front of a funnel, and a shadow mask fixed inside of the funnel with a certain distance from the panel, herein the shadow mask has a thickness of 50 μm~80 μm, and the panel has a transmittance of 47%~50%.

The flat tension mask type CRT has a luminance of not less than 31 FL, and the panel has a thickness of 13 mm~14.5 mm.

DETAILED DESCRIPTION OF THE PREFERRED EMBODIMENT

Hereinafter, the preferred embodiment of a flat tension mask type CRT (Cathode Ray Tube) in accordance with the present invention will now be described with reference to accompanying drawings.

Figure 5:
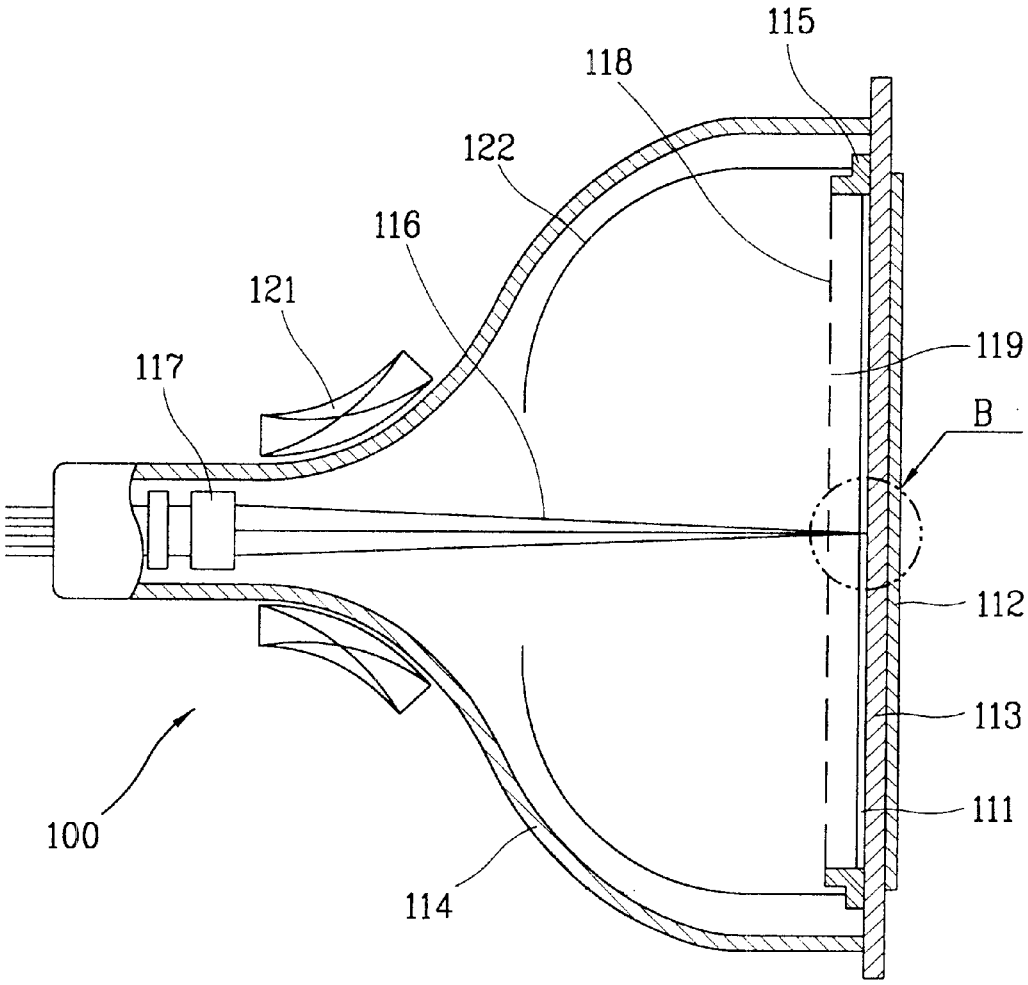
FIG. 5 is a cross-sectional view illustrating a flat CRT in accordance with the present invention.

FIG. 5 is a cross-sectional view illustrating a flat CRT in accordance with the present invention.

Figure 6:
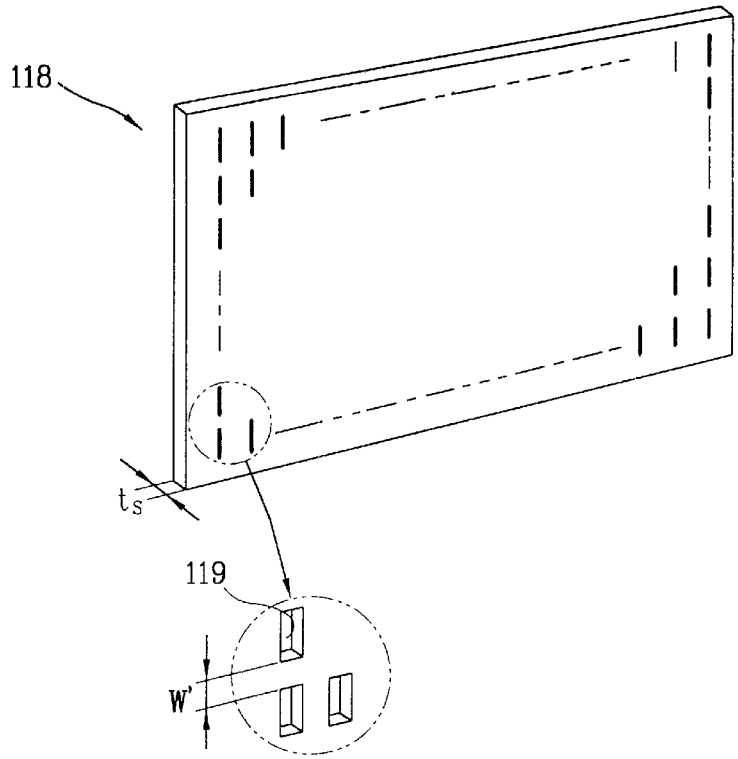
FIG. 6 is a schematic view illustrating a shadow mask used in FIG. 5.

FIG. 6 is a schematic view illustrating a shadow mask used in FIG. 5.

Figure 7:
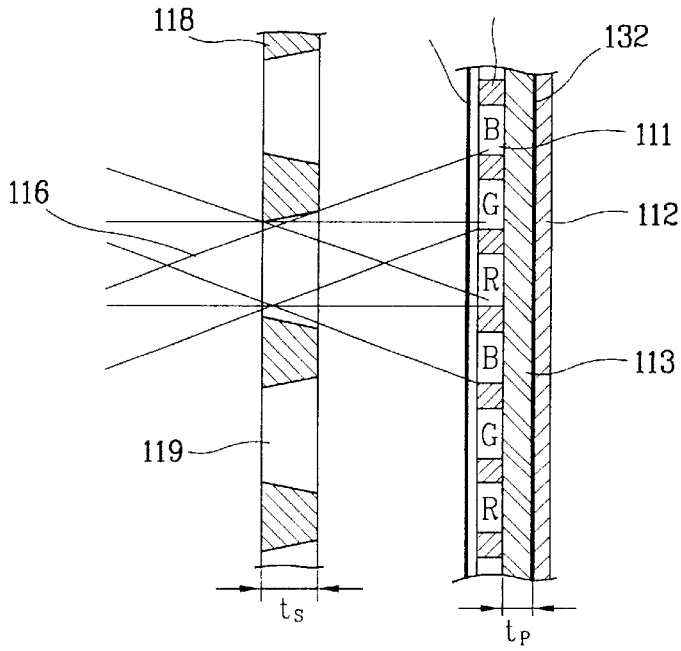
FIG. 7 is a detailed view of a "B" region of FIG. 5, it is a perspective schematic view illustrating a section of a shadow mask, an electron beam passing the section, and a panel in accordance with the present invention.

FIG. 7 is a detailed view of a "B" region of FIG. 5, it is a perspective schematic view illustrating a section of a shadow mask, an electron beam passing through the section, and a panel in accordance with the present invention.

With reference to FIG. 5, the flat tension mask type CRT in accordance with the present invention comprises a funnel 114 as a vacuum bulb for making a vacuum state in order to prevent the electron beam from breaking away from a landing path toward the fluorescent material by an obstacle, a panel 113 for fixing the funnel 114 and reproducing an image, and an electron gun 117 for discharging an electron beam 116 by receiving an electric signal.

The panel 113 is formed as a flat, and it comprises a fluorescent material 111 coated with a plurality of stripes or dots shape fluorescent material.

And, a safety glass 112 having a transmittance of 92% and having not less than two layers such as a dust layer, a discharge layer etc. is adhered to the front surface of the panel 113 by a resin 132 as a hardening adhesion.

Herein, the safety glass 112 is for preventing the damage of the panel 113 caused by stiffness lowering in inverse proportion to curvature due to the flat fabrication of the panel 113.

A rail 115 is adhered to each inner wall side of the panel 113 by a flit glass, and the end side of the shadow mask is fixed to the rail 115 by welding.

Accordingly, there is a certain distance between the shadow mask 118 and the fluorescent screen 111 of the panel 113.

In the meantime, a rectangular inner shield 122 is fixed to the side of the rail 113 in order to prevent the electron beam 116 scanned by the electron gun 117 from landing on the other fluorescent material by breaking away from the fluorescent material to be landed due to the magnetic field of the deflection yoke 121 etc.

In FIG. 7, a non-explanation reference numeral 131 is an aluminum layer, and a non-explanation reference numeral 133 is a screen.

Figure 2:
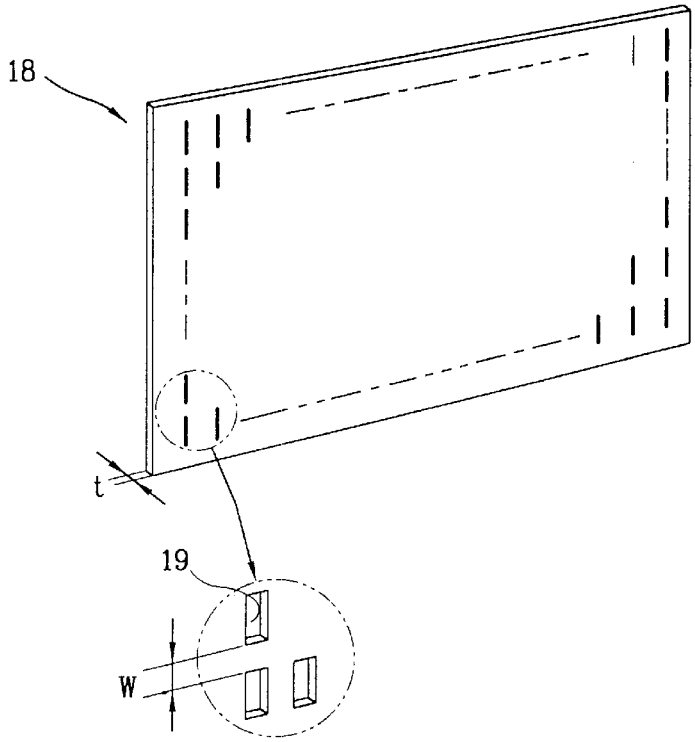
FIG. 2 BACKGROUND ART
FIG. 2 is a schematic view illustrating a shadow mask of FIG. 1.
Figure 3:
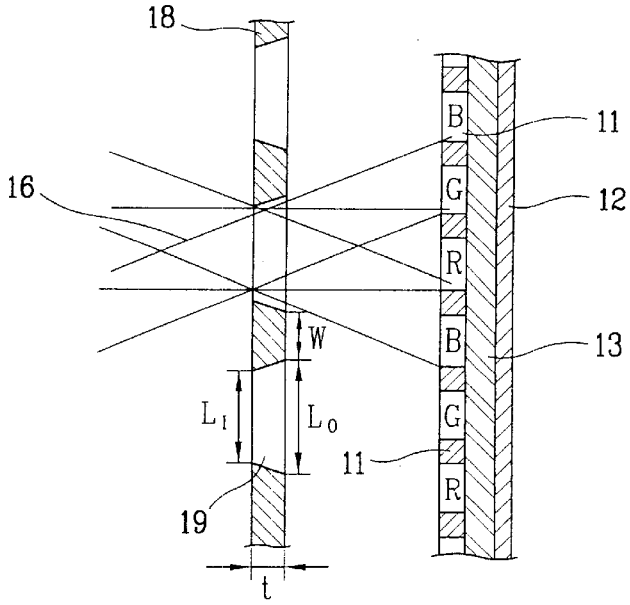
FIG. 3 BACKGROUND ART
FIG. 3 is a detailed view of an "A" part of FIG. 1, it is a perspective schematic view illustrating a section of a shadow mask, an electron beam passing through the section, and a panel.
Figure 4:
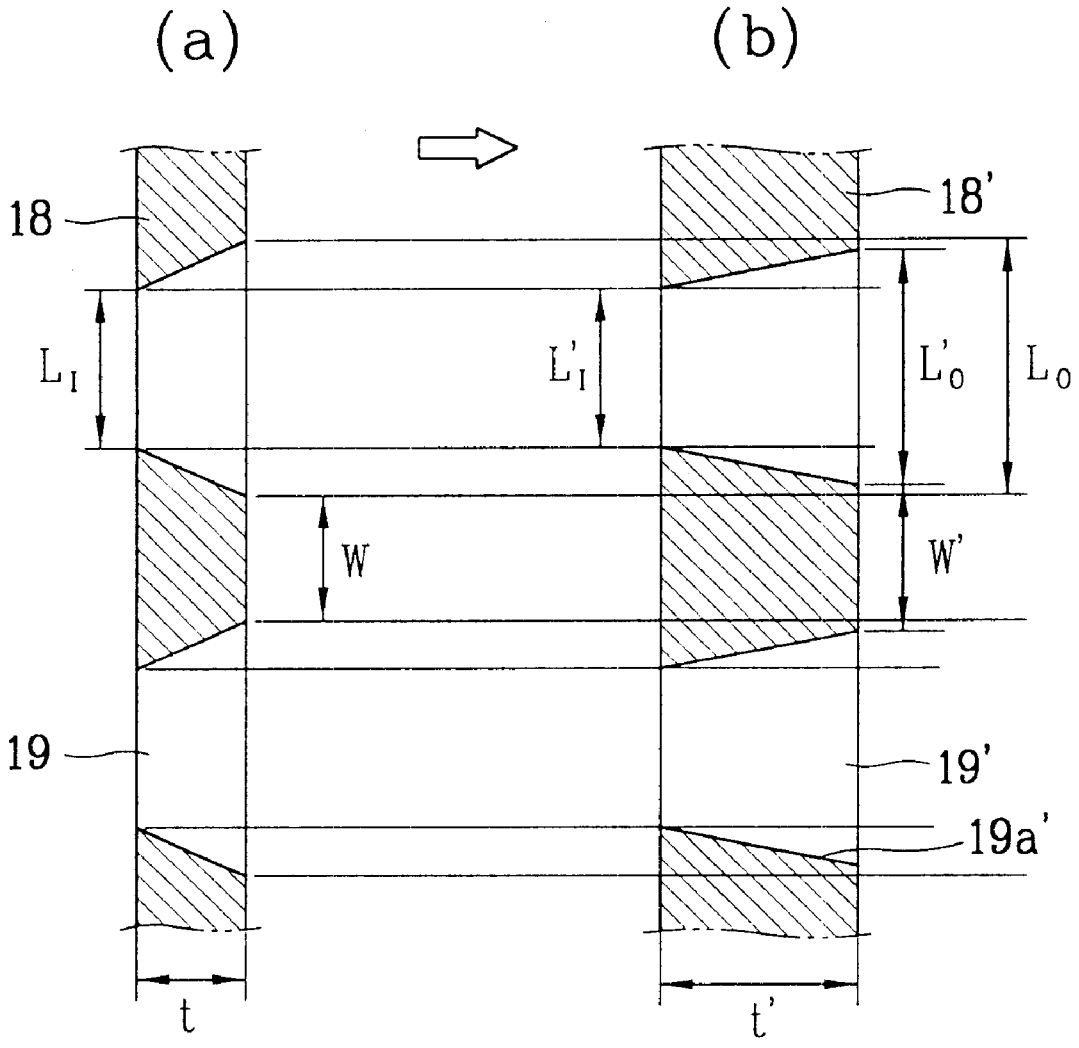
FIG. 4 BACKGROUND ART
FIG. 4 is a perspective comparison view illustrating variation of a bridge width when a thickness of a shadow mask increases.

In the flat tension mask type CRT in accordance with the present invention, the shadow mask 118 has a thickness $t_s$ of 50 μm~80 μm which is thicker than the thickness t as 25 μm in the prior art as depicted in FIG. 2.

And, between a tint glass and a clear glass used for the general material of a panel, the tint glass is used for the panel 113, herein the panel 113 is formed so as to have a transmittance of 47%~50%.

And, the panel 113 has a thickness $t_p$ of 13 mm~14.5 mm in order to have a transmittance of 47%~50%.

In addition, the panel 113 is set as an average roughness on the inner side where the fluorescent material is coated has a stipple depth not greater than 2.5 μm, it is advisable for the panel 113 to have depth of 0.7 μm~2.5 μm.

Figure 1:
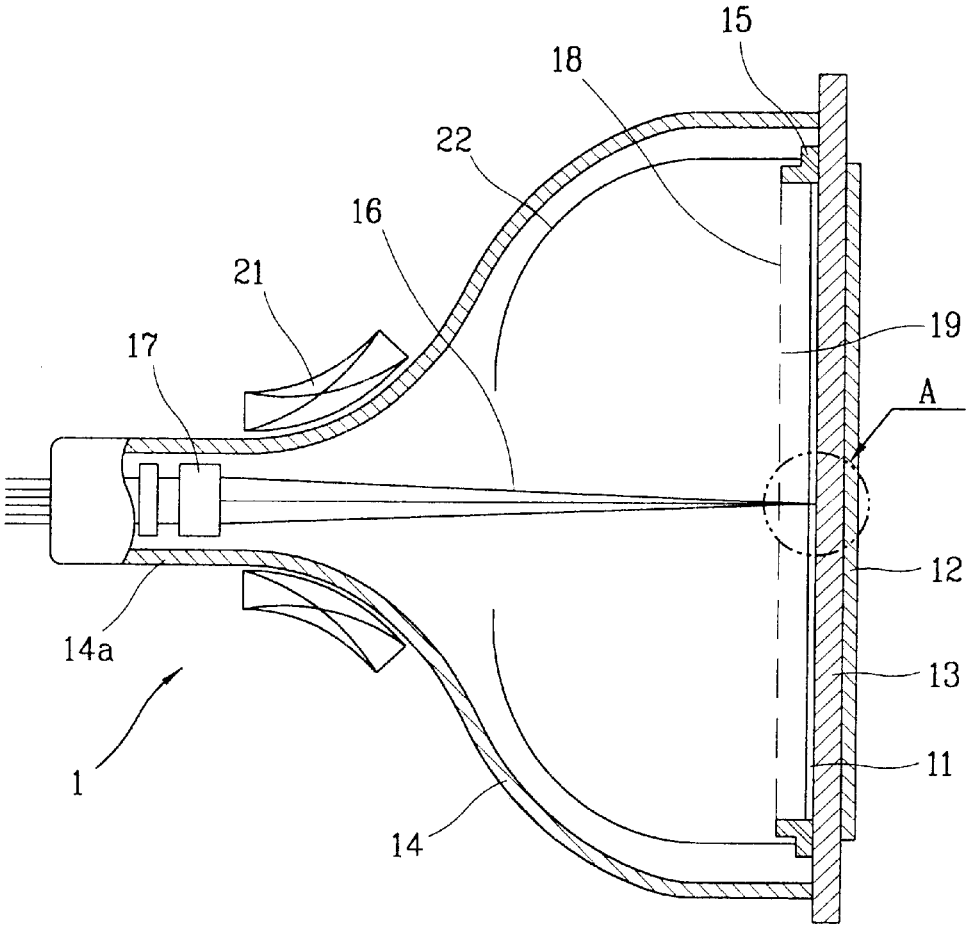
FIG. 1 BACKGROUND ART
FIG. 1 is a cross-sectional view illustrating a flat CRT in accordance with the prior art.

In the meantime, as depicted in FIG. 1, the panel constructed with the tint glass in the prior art has a transmittance of about 42%, and has a thickness of 15.3 mm.

In the present invention, because the more transmittance of the panel 113 heightens, the more overall luminance of the CRT 100 heightens, accordingly the transmittance of the panel 113 heightens on the comparison with the prior art in order to prevent lowering of the luminance of the overall CRT 100 due to the increase of the thickness of the shadow mask 118.

The transmittance of the panel 113 is influenced by the thickness variation, the transmittance Tg of the panel 113 is determined by equation 1.

$$Tg=(1-R)^2\times e^{-kt} \quad (1)$$

Herein, R is a surface reflexibility of the panel, k is an absorption coefficient, and t is the thickness of the panel.

When the panel 113 is constructed with the tint glass, the R value is 4.5%, and the k is 0.04626.

When the panel 113 has a thickness of 15.3 mm as the thickness in the prior art, it has a transmittance Tg of 45%, when the panel 113 has a thickness of 15.0 mm thinner than the thickness in the prior art, it has a transmittance Tg of 45.6%, when the panel 113 has a thickness of 14 mm, it has a transmittance Tg of 47.7%, and when the panel 113 has a thickness of 13 mm, it has a transmittance Tg of 50%.

Accordingly, in order to get the transmittance Tg between 47%~50%, the panel has to have a thickness $t_p$ of 13 mm~14.5 mm, it is advisable for the panel 113 to have a thickness of 13.5 mm.

However, when the transmittance of the panel 113 heightens more, although the overall luminance of the CRT 100 improves, a contrast characteristic lowers, the clearness of the picture lowers, accordingly it is advisable to set the thickness $t_p$ not less than 13.0 mm in order to get the transmittance not greater than 50%.

In addition, when the thickness $t_p$ of the panel 113 lowers not greater than 13.0 mm, although the luminance increases by the transmittance heightening, it is difficult to maintain the durability of the CRT 100 by lowering of an explosion proof characteristic of the panel 113, accordingly it is advisable to set the thickness $t_p$ of the panel 113 not less than 13.0 mm.

As described above, when the transmittance improves by making the thickness $t_p$ of the panel 113 thinner, the overall luminance FL of the CRT 100 can improve through equation 2.

$$FL = \frac{(Ts \cdot Tg \cdot Tm \cdot Tal \cdot Tscreen \cdot Tr \cdot Eb \cdot Ik \cdot C \cdot \eta \cdot \delta)}{(A \cdot \pi)} \quad (2)$$

As described above, Ts is the transmittance of the safety glass 112, Tg is the transmittance of the panel 113, Tm is the transmittance of the shadow mask 118, Tal is the transmittance of the aluminum layer 131, Tscreen is the transmittance of the screen 133, Tr is the transmittance of the resin 132, Eb is the transmittance of a rated voltage by models, Ik is a cathode current of the electron gun 117, C is a FL transmutation constant, η is the efficiency of the fluorescent material, A is the width of the screen 133, and δ is a temporary constant.

As described above, the final luminance FL of the CRT (Cathode Ray Tube) 100 calculated with equation 2 is determined by major variables such as the panel 113, safety glass 112, resin 132, and transmittance of the shadow mask 131 etc.

Herein, in order to make the fabrication easier, in the flat tension mask type CRT in accordance with the present invention, the thickness of the shadow mask 118 is set not less than 50 μm, and the transmittance of the safety glass 112, screen 133, resin 132, aluminum layer 131 etc. are set as below by considering production cost and productivity etc.

The safety glass 112 has a transmittance (Ts) of 92%, the aluminum layer 131 has a transmittance (Tal) of 100%, the screen 133 has a transmittance (Tscreen) of 62.8%, the resin 132 has a transmittance (Tr) of 98%, the rated voltage by models is 26 KV, the cathode current (IK) is 600 μA, the temporary constant (δ) is 0.83, the FL variable constant (c) is 0.2919, the efficiency of the fluorescent material (η) is 38, and the width of the screen (A) is $(0.315 \times 0.235)m^2$.

Herein, the resin 132 is the hardening adhesion for adhering the safety glass 122 to the panel 113, it is acrylaid constructed with major constituents of 42% IBOA (ISobonylacrylate) and 28% FA_2D (Caprolactone) having a viscosity of 60~80CPS, a reflective index of 1.44~1.48, a specific gravity of 1.0~1.1 $g/cm^3$, and a permeability of 98~100%.

Hereinafter, the process for getting a certain luminance FL of the CRT (Cathode Ray Tube) 100 in accordance with the variation of the thickness $t_s$ of the shadow mask 118 and variation of the transmittance Tg of the panel 113 will now be described.

First, the transmittance of the panel 113 is set as 47%, the thickness $t_s$ of the shadow mask 118 is set as 50 μm, and the final luminance FL of the CRT 100 is calculated with equation 2.

Herein, because the shadow mask 118 has a bridge width W' of about 0.035~0.037 mm as depicted in table 1 in the prior art, the transmittance Tm is between 19.1~19.5%, when the final luminance FL is calculated with equation 2 by setting the transmittance Tm of the shadow mask 118 as 19.30%, the final luminance is 31.7 FL which is almost same with the final luminance in the 25 μm thickness of the shadow mask.

Next, when the transmittance Tg of the panel 113 is set as 48%, the thickness $t_s$ of the shadow mask 118 is set as 50 μm, and rest variables are same, the final luminance FL of the CRT (Cathode Ray Tube) 100 is calculated with equation 2.

In other words, when Ts (the transmittance of the safety glass)=92%, Tg (the transmittance of the panel)=48%, Tm (the transmittance of the shadow mask)=19.30%, Tal (the transmittance of the aluminum layer)=100%, Tscreen (the transmittance of the screen)=62.8%, Tr (the transmittance of the resin)=98%, Eb (the rated voltage by models)=26 KV, IK (the cathode current)=600 μA, δ (the temporary constant)=0.83, C (the FL variable constant)=0.2919, 72 (the efficiency of the fluorescent material)=38, A (the width of the screen)=$0.315 \times 0.235\ m^2$, the final luminance of the CRT (Cathode Ray Tube) 100 calculated with equation 2 is 32.4 FL.

Next, the transmittance of the panel 113 is set as 49%, the thickness of the shadow mask is set as 50 μm, and the rest variables are same, the final luminance FL of the CRT 100 is calculated with equation 2.

In other words, when Ts (the transmittance of the safety glass)=92%, Tg (the transmittance of the panel)=49%, Tm (the transmittance of the shadow mask)=19.30%, Tal (the transmittance of the aluminum layer)=100%, Tscreen (the transmittance of the screen)=65.8%, Tr (the transmittance of the resin)=98%, Eb (the rated voltage by models)=26 KV, IK (the cathode current)=600 μA, δ (the temporary constant)=0.83, C (the FL variable constant)=0.2919, η(the efficiency of the fluorescent material)=38, A (the width of the screen)=$0.315 \times 0.235m^2$, accordingly the final luminance of the CRT 100 calculated with equation 2 is 33.1 FL.

Next, when the transmittance Tg of the panel 113 is set as 50%, the thickness $t_s$ of the shadow mask is set as 50 μm, and the rest variables are same, the final luminance FL of the CRT 100 (Cathode Ray Tube) can be calculated with equation 2.

In other words, when Ts (the transmittance of the safety glass)=92%, Tg (the transmittance of the panel)=50%, Tm (the transmittance of the shadow mask)=19.30%, Tal (the transmittance of the aluminum layer)=100, Tscreen (the transmittance of the screen)=62.8% Tr (the transmittance of the resin)=98% Eb (the rated voltage by models)=26 KV, IK (the cathode current)=600 μA, δ (the temporary constant)=0.83, C (the FL variable constant)=0.2919, η (the efficiency of the fluorescent material)=38, A (the width of the screen)=$0.315 \times 0.235\ m^2$, accordingly the final luminance of the CRT 100 calculated with equation 2 is 33.7 FL.

As described above, the final luminance FL among 31.7 FL~33.7 FL can be gotten by improving the transmittance Tg as 47%~50%, by increasing the thickness $t_s$ of the shadow mask 118 as 50 μm and decreasing the thickness of $t_p$ of the panel 113 as 13 mm~14.5 mm.

In other words, when Ts (the transmittance of the safety glass)=9%, Tg (the transmittance of the panel)=50, Tm (the transmittance of the shadow mask)=19.30, Tal (the transmittance of the aluminum layer)=100, Tscreen (the transmittance of the screen)=6%.8, Tr (the transmittance of the resin)=98, Eb (the rated voltage by models)=%6 KV, IK (the cathode current)=600 μA, δ (the temporary constant)=0.83, C (the FL variable constant)=0.%919, η (the efficiency of the fluorescent material)=38, A (the width of the screen)=$0.315 \times 0.\%35\ m^2$, accordingly the final luminance of the CRT 100 calculated with equation % is 33.7 FL.

As described above, the final luminance FL among 31.7 FL~33.7 FL can be gotten by improving the transmittance Tg as 47~50 by increasing the thickness $t_s$ of the shadow mask 118 as 50 μm and decreasing the thickness $t_p$ of the panel 113 as 13 mm~14.5 mm.

The results discussed above are summarized in Table 2 below.

TABLE 2

| Shadow Mask Thickness (t) | Transmittance of panel (Tg) | Luminance of CRT (FL) |
|---|---|---|
| 50 μm | 47% | 31.7 |
| 50 μm | 48% | 32.4 FL |
| 50 μm | 49% | 33.1 |
| 50 μm | 50% | 33.7 |

The same phenomena was present for shadow mask thickness greater than 50 μm and up to 80 μm.

Accordingly, when the thickness $t_s$ of the shadow mask 118 increases as 50 μm~80 μm, the flat tension mask type CRT in accordance with the present invention is capable of guaranteeing an appropriate luminance of the CRT (Cathode Ray Tube) 100 by comprising the panel 113 having 47%~50% transmittance, making the fabrication and handing of the shadow mask 118 easier, and improving the durability, accordingly the fabrication of the flat CRT 100 is easier.

In addition, in the flat tension mask type CRT in accordance with the present invention, because the volume increases on the comparison with the prior art according to increase of the thickness $t_s$ of the shadow mask 118, the heat capacity increases, accordingly the volume variation due to the temperature rise occurred by the collision of the electron beam in operation of the CRT (Cathode Ray Tube) 100 can decrease.

And, because the position variation of the shadow mask 118 due to the doming is not big by reducing the volume variation of the shadow mask 118, the color vividness and luminance of the picture quality of the CRT (Cathode Ray Tube) 100 improve by reducing the variation quantity of the electron beam.

Accordingly, the flat tension mask type CRT in accordance with the present invention is capable of heightening the productivity and durability by increasing the thickness $t_s$ of the shadow mask 118, and improving the overall luminance and color vividness of the CRT 100.

As the present invention may be embodied in several forms without departing from the spirit or essential characteristics thereof, it should also be understood that the above-described embodiments are not limited by any of the details of the foregoing description, unless otherwise specified, but rather should be constructed broadly within its sprit and scope as defined in the appended claims, and therefore all changes and modifications that fall within the meets and bounds of the claims, or equivalence of such meets and bounds are therefore intended to be embraced by the appended claims.

What is claimed is:

1. A flat tension mask type CRT (Cathode Ray Tube), comprising:

a flat panel fixed on a front of a funnel of the CRT; and a shadow mask fixed inside of the funnel at a predetermined distance from the panel, wherein the shadow mask has a thickness of 50 μm~80 μm, and the panel has a transmittance of 47%~50%.

2. The flat tension mask type CRT according to claim 1, wherein the flat CRT has a luminance of not less than 31FL.

3. The flat tension mask type CRT according to claim 2, wherein the flat CRT has a luminance of 31.7FL~33.7FL.

4. The flat tension mask type CRT according to claim 1, wherein the shadow mask has a bridge width of 0.035 mm~0.037 mm as a width in the vertical direction between through holes where electron beams pass.

5. The flat tension mask type CRT according to claim 4, wherein the shadow mask has a transmittance of 19.1%~19.5%.

6. The flat tension mask type CRT according to claim 1, wherein the panel has a thickness of 13 mm~14.5 mm.

7. The flat tension mask type CRT according to claim 6, wherein the panel has a thickness of 13.5 mm.

8. The flat tension mask type CRT according to claim 6, wherein the panel has a stipple depth not greater than 2.5 μm as an average roughness in a side where a fluorescent screen is formed.

9. The flat tension mask type CRT according to claim 8, wherein the panel has an average roughness of 0.7 μm~2.5 μm stipple depth.

10. The flat tension mask type CRT according to claim 1, wherein the panel is constructed with a tint glass.

11. A flat tension mask type CRT (Cathode Ray Tube), comprising:

a flat panel fixed on a front of a funnel of the CRT; and a shadow mask fixed inside of the funnel at a predetermined distance from the panel, wherein the shadow mask has a thickness of 50 μm~80 μm, and the panel has a transmittance of 47%~50%, and wherein a safety glass is adhered to the front surface of the panel by a resin, and the safety glass has a transmittance of 92%.

12. The flat tension mask type CRT according to claim 11, wherein a fluorescent screen is formed on an inner surface of the panel, wherein an aluminum layer is positioned a predetermined distance from the screen, and wherein the resin has a transmittance of 98%, the screen has a transmittance of 62.8%, the aluminum layer has a transmittance of 100%, the fluorescent material has an efficiency of 38, and the screen has a width of $(0.315\times0.235)m^2$.

13. The flat tension mask type CRT according to claim 12, wherein the resin is constructed with acrylaid having 42% IBOA (lSobonylacrylate) and 28% FA_2D (Caprolactone) as major constituents in order to have a viscosity of 60~80CPS, a reflective index of 1.44~1.48, a specific gravity of 1.0~1.1 $g/cm^3$, and a permeability of 98~100%.

14. A flat tension mask type CRT, comprising:

a funnel;

an electron gun positioned in a neck of the funnel;

a deflection yoke positioned around an outer circumference of the neck of the funnel;

a flourescent material provided on an inner surface of a panel; and a shadow mask positioned inside the funnel a predetermined distance from the panel, wherein the shadow mask has a thickness of 50 μm~80 μm, and the panel has a transmittance of 47%~50%.

15. A flat tension mask type CRT (Cathode Ray Tube) consisting of:

a flat panel fixed on a front of a funnel of the CRT; and a shadow mask fixed inside of the funnel at a predetermined distance from the panel, wherein the shadow mask has a thickness of 50 μm~80 μm, and the panel has a transmittance of 47%~50%.

* * * * *